United States Patent [19]

Okoma et al.

[11] Patent Number: 5,051,076

[45] Date of Patent: Sep. 24, 1991

[54] TWO-CYLINDER-TYPE ROTARY COMPRESSOR SYSTEM HAVING IMPROVED SUCTION PIPE COUPLING STRUCTURE

[75] Inventors: Kaoru Okoma, Fujinomiya; Masashi Ohmura, Fuji, both of Japan

[73] Assignee: Kabushiki Kaisha Toshiba, Kawasaki, Japan

[21] Appl. No.: 427,478

[22] Filed: Oct. 27, 1989

[30] Foreign Application Priority Data

Oct. 31, 1988 [JP] Japan ..... 63-275585

[51] Int. Cl.[5] ..... F04B 25/00; F04C 29/08

[52] U.S. Cl. ..... 418/60; 29/888.02; 29/890.149; 29/890.147; 417/902; 417/540

[58] Field of Search ..... 418/60, 181, 200, 212; 417/540, 902, 572, 312; 29/156.4 R, 157.6; 285/158, 189, 285, 287

[56] References Cited

U.S. PATENT DOCUMENTS

| | | | |
|---|---|---|---|
| 1,702,939 | 2/1929 | Greenfield | 418/60 |
| 2,495,615 | 1/1950 | Vander Clute | 285/158 |
| 3,750,248 | 8/1973 | Morris | 29/157.6 |
| 4,242,056 | 12/1980 | Dyhr et al. | 417/902 |
| 4,486,153 | 12/1984 | Romer et al. | 417/312 |
| 4,640,669 | 2/1987 | Cannaway | 417/902 |
| 4,697,831 | 10/1987 | Thalmann | 285/158 |
| 4,764,097 | 8/1988 | Hirahara et al. | 418/60 |

FOREIGN PATENT DOCUMENTS

| | | | |
|---|---|---|---|
| 0222109 | 5/1987 | European Pat. Off. . | |
| 3540445 | 5/1986 | Fed. Rep. of Germany . | |
| 59-28087 | 2/1984 | Japan . | |
| 61-152791 | 9/1986 | Japan . | |
| 62-24084 | 2/1987 | Japan . | |
| 219893 | 9/1988 | Japan | 417/312 |
| 808378 | 2/1959 | United Kingdom . | |
| 2202905 | 10/1988 | United Kingdom . | |

OTHER PUBLICATIONS

*Taschenbuch Maschnenbau*, Luck, K. (Veb Verlag Technik, Berlin, 1987), pp. 204, 205.

*Primary Examiner*—Leonard E. Smith
*Assistant Examiner*—David L. Cavanaugh
*Attorney, Agent, or Firm*—Cushman, Darby & Cushman

[57] ABSTRACT

A sealed case has first and second housing portions. A motor section is arranged in the first housing portion of the sealed case and has a rotating shaft extending in the second housing portion. A compression mechanism section is arranged in the second housing portion of the sealed case and has first and second cylinders stacked on each other and first and second crank portions which are formed on the rotating shaft in the first and second cylinders, respectively. An accumulator is arranged outside the sealed case so as to substantially oppose an arrangement position of the motor section. A first suction pipe connects the accumulator to the first cylinder of the compression mechanism section. A second suction pipe is arranged outwardly from the first suction pipe so as to connect the accumulator to the second cylinder of the compression mechanism section. The second suction pipe has a first coupling pipe having one end coupled to the second cylinder, a second coupling pipe having one end coupled to the accumulator, and adjustment coupling portions for coupling the other end of each of the first and second coupling pipes so as to freely adjust positions thereof.

4 Claims, 3 Drawing Sheets

TWO-CYLINDER-TYPE ROTARY COMPRESSOR SYSTEM HAVING IMPROVED SUCTION PIPE COUPLING STRUCTURE

BACKGROUND OF THE INVENTION

1. Field of the Invention

The present invention generally relates to a compressor system and, more particularly, to an improvement in a suction pipe coupling structure of a two-cylinder-type rotary compressor system having two cylinders in a sealed case.

2. Description of the Related Art

A two-cylinder-type rotary compressor having two cylinders in a sealed case has been known as a compressor used for refrigerators, air conditioners, and the like.

A two-cylinder-type rotary compressor employing such a system generally has an arrangement shown in FIG. 4 (prior art). A sealed case 2 of a rotary compressor 1 is partitioned into two portions, i.e., upper and lower portions by a stationary frame 3. A compression mechanism 4 and a motor section 5 are respectively arranged in the lower and upper portions of the sealed case 2. A stator 6 of the motor section 5 is fitted in the inner surface of the sealed case 2. A rotor 8 is rotatably supported inside the stator 6. The rotor 8 has a center axis vertically extending in the sealed case 2 and is coupled to a rotating shaft 7.

The rotating shaft 7 is supported by the stationary frame 3 with the lower end of the shaft 7 extending through a bearing portion 3*a* of the frame 3. Two crank portions 9 and 10 are stacked on each other together with a spacer 3*b* and a sub-bearing 3*c* at the lower end of the rotating shaft 7 extending downward from the stationary frame 3.

Cylinders 11 and 12 are respectively arranged at positions corresponding to the outer surfaces of the crank portions 9 and 10. Rollers 13 and 14 are respectively arranged in the crank portions 9 and 10 located inside the cylinders 11 and 12 so as to be eccentric with the rotating shaft 7. Blades (not shown) are in contact with the rollers 13 and 14. The blades 13*a* and 14*a* extend from the inner surfaces of the cylinders 11 and 12, respectively, so as to be freely moved backward and forward elastically. The blades partition compression chambers P1 and P2, respectively, which are defined between the rollers 13 and 14 eccentrically rotated with a phase difference of 180° and the cylinders 11 and 12. That is, the volumes of the compression chambers P1 and P2 are gradually reduced, and hence a refrigerant in each chamber can be compressed.

The compressed refrigerant is discharged from a discharge pipe 2*b* through discharge paths (not shown).

Two suction pipes 16 and 17 are respectively connected to the cylinders 11 and 12 located at upper and lower positions as described above so as to supply the above refrigerant. The pipes 16 and 17 extend from the lower end of an accumulator 15 which is fixed to the sealed case 2 through a fixing member 2*a*.

The above suction pipes 16 and 17 are coupled to the accumulator 15 in advance, and are forcibly inserted in the cylinders 11 and 12 of the sealed case 2. Thereafter, the pipes 16 and 17 are externally welded to the sealed case 2, thus coupling the pipes 16 and 17 to the case 2. However, since each suction pipe has a small thickness, noise and vibration occur due to insufficient strength. In addition, in the process of attaching the suction pipes 16 and 17 coupled to the accumulator 15 to the sealed case 2 while the cylinders 11 and 12 are coupled/fixed in the sealed case 2, assembly becomes difficult.

More specifically, if there is an error such as a manufacturing error between the central distance of the cylinders 11 and 12 and that of the suction pipes 16 and 17, assembly becomes impossible. For this reason, the cylinders 11 and 12, the stationary frame 3, and the like must be selected to allow coupling positions of the respective parts to fall within a predetermined dimension range.

In brief, in a conventional, general two-cylinder-type rotary compressor, two cylinders are arranged along a rotating shaft arranged in a sealed case. One end of each suction pipe is connected to a corresponding cylinder in the radial direction. The other ends of these suction pipes extend parallel to each other, and are bent to extend along the axial direction of a rotating shaft so as to be coupled to an accumulator. The two-cylinder-type rotary compressor having the above-described arrangement is manufactured such that one end of each of the two suction pipes which are connected to the accumulator in advance is connected to a corresponding cylinder in the sealed case. With this arrangement, when the suction pipes are to be connected, the interval of the cylinders and the like must be adjusted to fall within a predetermined dimensional range, and hence processing and adjustment of parts are laborious. In addition, since the thickness of each suction pipe is small, noise and vibration tend to occur due to insufficient strength.

SUMMARY OF THE INVENTION

It is, therefore, an object of the present invention to provide a new and improved two-cylinder-type rotary compressor which has a suction pipe coupling structure improved to facilitate adjustment for coupling of suction pipes and to effectively reduce noise and vibration.

It is another object of the present invention to provide a method of coupling suction pipes used for a rotary compressor, which allows each adjustment of coupling of the suction pipes.

According to one aspect of the present invention, there is provided a rotary compressor comprising:

- a sealed case having first and second housing portions;
- a motor section arranged in the first housing portion of the sealed case and having a rotating shaft extending in the second housing portion;
- a compression mechanism section arranged in the second housing portion of the sealed case and having first and second cylinders stacked on each other and first and second crank portions which are formed on the rotating shaft in the first and second cylinders, respectively;
- an accumulator arranged outside the sealed case so as to substantially oppose an arrangement position of the motor section;
- a first suction pipe for connecting the accumulator to the first cylinder of the compression mechanism section; and
- a second suction pipe, arranged outwardly from the first suction pipe, for connecting the accumulator to the second cylinder of the compression mechanism section, the second suction pipe having a first coupling pipe having one end coupled to the second cylinder, a second coupling pipe having one end coupled to the accumulator, and adjustment coupling portions for coupling the other end of each of the first and second coupling pipes so as to freely adjust positions thereof.

According to another aspect of the present invention, there is provided a structure of a rotary compressor, wherein a motor section is arranged in a sealed case, first and second cylinders are sequentially arranged along a rotating shaft of the motor section so as to constitute a compression mechanism section, an accumulator is arranged outside the sealed case, the first and second cylinders are connected to the accumulator through first and second suction pipes, respectively, the second suction pipe located outwardly from the first suction pipe is constituted by first and second coupling pipes, and coupling portions for connecting the first and second coupling pipes by inserting one of the coupling pipes in the other coupling pipe by a predetermined length are provided.

According to still another aspect of the present invention, there is provided a method of coupling suction pipes used for a rotary compressor, comprising the steps of coupling a first suction pipe and a first coupling pipe to an accumulator, inserting a coupling portion of a second coupling pipe to a coupling portion of the first coupling pipe in a non-coupled state, setting the first suction pipe and the second coupling pipe at corresponding coupling positions of a sealed case, and coupling the first suction pipe and the second coupling pipe to the coupling positions of the sealed case, and coupling the coupling portions of the first and second coupling pipes to each other, thereby constituting a second suction pipe.

According to the first and second aspects of the present invention, the second suction pipe located outwardly from the first suction pipe is constituted by the first and second coupling pipes and one of the coupling pipes is inserted in the other coupling pipe, thereby overlapping and coupling their coupling portions. With this structure, the thickness of the second suction pipe located outwardly can be increased, and hence occurrence of noise and vibration can be effectively reduced. In addition, since the coupling portions are formed on the second suction pipe located outwardly, coupling can be easily performed.

According to the third aspect of the present invention, when the two suction pipes coupled to the accumulator are to be respectively connected to the two cylinders, the distance between the centers of the suction pipes to be connected to the cylinders can be adjusted by the coupling portions. Therefore, adjustment upon connection of the suction pipes to the respective cylinders ca be facilitated.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 2 and 3 are partially cutaway views, each showing a main part of the second embodiment of the present invention, in which FIG. 2 is a sectional front view showing suction pipes coupled through fixing pipes, and FIG. 3 is a sectional front view showing a modification of the fixing pipes.

DETAILED DESCRIPTION OF THE PREFERRED EMBODIMENTS

Figure 1:
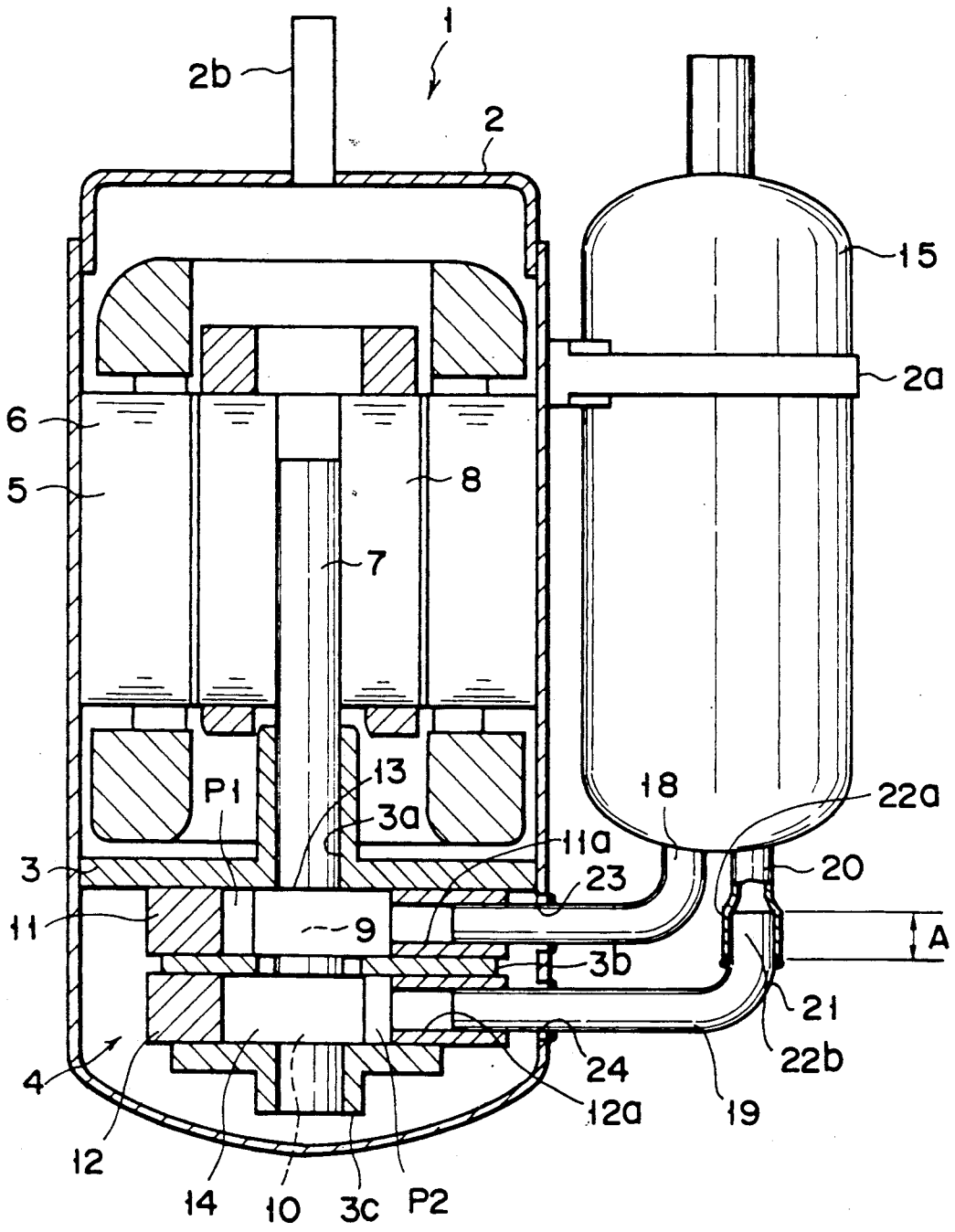
FIG. 1 is a sectional front view of a rotary compressor according to the first embodiment of the present invention.

The first embodiment of the present invention will be described below with reference to FIG. 1. A two-cylinder-type rotary compressor 1 shown in FIG. 1 has a sealed case 2. The sealed case 2 is outwardly divided into two housing portions, i.e., upper and lower portions by a stationary frame 3 arranged therein. A compression mechanism section 4 and a motor section 5 are respectively arranged in the lower and upper housing portions of the sealed case 2. The motor section 5 has a stator 6 fitted in the inner surface of the sealed case 2, and a rotor 8 located at the center of the stator 6. A rotating shaft 7 is fitted in the rotor 8 at its rotation center. The rotating shaft 7 is rotatably supported by the stationary frame 3 with one end of the shaft 7 extending through a bearing portion 3*a* of the frame 3.

First and second cylinders 11 and 12 are stacked and coupled to the lower surface of the stationary frame 3 together with a spacer 3*b* and a sub-bearing 3*c*. One end of the rotating shaft 7 extends through the cylinders 11 and 12. Crank portions 9 and 10 are formed at positions of the rotating shaft 7 corresponding to the cylinders 11 and 12. Rollers 13 and 14 are rotatably attached to the outer surfaces of the crank portions 9 and 10 so as to be eccentric with the rotating shaft 7 and have a phase difference of 180°. Two blades (not shown) are in contact with the outer surfaces of the rollers 13 and 14, respectively. The blades extend from the inner surfaces of the cylinders 11 and 12, respectively, so as to freely move forward and backward elastically. The blades partition compression chambers P1 and P2 defined between the rollers 13 and 14 which are rotated eccentrically with the blades 13*a* and 14a, respectively, and the cylinders 11 and 12. As the rotating shaft 7 is rotated, the rollers 13 and 14 are rotated eccentrically with the rotating shaft 7 so as to gradually reduce the volumes of the compression chambers P1 and P2, thus compressing a refrigerant drawn into each of the suction chambers P1 and P2 by suction.

The compressed refrigerant is finally discharged from a discharge pipe 2*b* through discharge paths (not shown).

In order to supply the refrigerant, one end of each of first and second suction pipes 18 and 19 extending from the lower end of an accumulator 15 fixed to the outer surface of the sealed case 2 through a fixing member 2*a* is connected to a corresponding one of the cylinders 11 and 12.

The first suction pipe 18 is connected to the first cylinder 11 arranged at the upper side in the compression mechanism section 4. One end of the first suction pipe 18 is inserted through a through hole 23 formed in the side wall of the sealed case 2, and is forcibly inserted in a connecting hole 11*a* formed in the first cylinder 11. In this case, the first suction pipe 18 is bent in the form of a substantially L shape. One end of the pipe 18 is coupled to the first cylinder 11 in the radial direction, and the other end of the pipe 18 is coupled to the accumulator 15 in the axial direction of the rotating shaft 7.

The second suction pipe 19 comprises a first coupling pipe 20 coupled to the accumulator 15, and a second coupling pipe 21 coupled to the second cylinder 12 side. One end of the first coupling pipe 20 is coupled to the accumulator 15. The other end of the pipe 20 extends downward along the axial direction of the rotating shaft 7, and the inner diameter of the other end is enlarged. This inner diameter corresponds to the outer diameter of the other end of the second coupling pipe 21 which is fitted in the other end of the first coupling pipe 20. This diameter-enlarged portion is formed throughout a predetermined range indicated by a size A.

One end of the second coupling pipe 21 is inserted through a through hole 24 formed in the side wall of the sealed case 2, and is forcibly fitted in a connecting hole 12*a* formed in the second cylinder 12 so as to be coupled to the cylinder 12 in the radial direction. The other end of the pipe 21 extends outwardly from the first suction pipe 18 and is bent upward.

Coupling portions 22*a* and 22*b* whose positions can be adjusted are formed at the connecting portions of the first and second coupling pipes 20 and 21 throughout the size A.

When the accumulator 15 is connected to the sealed case 2, the two-cylinder-type rotary compressor 1 having the above-described arrangement is assembled in the following manner.

The first suction pipe 18 and the first coupling pipe 20 are coupled to the accumulator 15 in advance, and the second coupling pipe 21 is inserted in the first coupling pipe 20 without being coupled thereto. The first suction pipe 18 and the second coupling pipe 21 are inserted in the through-holes 23 and 24 formed in the sealed case 2 and are forcibly fitted in the connecting holes respectively formed in the first and second cylinders 11 and 12. Thereafter, the first suction pipe 18 and a portion of the sealed case 2 corresponding to the outer surface of the pipe 18 are coupled to each other by soldering from the outside.

The second suction pipe 19 is externally coupled to the sealed case 2 by coupling the second coupling pipe 21 to a portion of the sealed case 2 corresponding to the outer surface of the pipe 2 by soldering from the outside. In addition, the first and second coupling pipes 20 and 21 are coupled to each other by soldering the coupling portions 22*a* and 22*b* from the outside.

When the first and second suction pipes 18 and 19 are coupled in this manner, the coupling positions of the coupling portions 22*a* and 22*b* formed on the second suction pipe 19 can be set in accordance with the distance between the centers of the first and second suction pipes 18 and 19. Therefore, adjustment for assembly can be facilitated, and productivity can be improved.

In addition, the second suction pipe 19 is constituted by the first and second coupling pipes 20 and 21. The coupling portions 22*a* and 22*b* are formed on the first and second coupling pipes 20 and 21. The inner diameter of the end portion of the first coupling pipe 20 coupled to the accumulator 15 is enlarged. The end portion of the second coupling pipe 2 coupled to the sealed case 2 is inserted in this enlarged end portion, thereby performing a welding process without being interfered by the accumulator 15.

Furthermore, since the coupling portions 22*a* and 22*b* to be overlapped on each other are formed on the second suction pipe 19 having a longer pipe path, rigidity of the second suction pipe 19 upon assembly can be increased. In addition, since the thickness of the pipe 19 is increased, noise which is produced when a refrigerant passes, can be reduced.

Moreover, even if the stationary frame 3 arranged in the sealed case 2 and the cylinders 11 and 12 are assembled with low dimensional precision, which disables assembly of suction pipes in the conventional structure, the suction pipes can be assembled by adjusting the positions of the coupling portions 22*a* and 22*b* of the first and second coupling pipes 20 and 21.

The second embodiment of the present invention will be described below with reference to FIGS. 2 and 3. Since a rotary compressor 1 of this embodiment has the same structure as that of the compressor of the first embodiment, only different points will be described. In the second embodiment, tubular fixing pipes 25 and 26 are previously soldered to the sealed case 2 to contain the compressor mechanism portion 4 in the sealed case 2. The suction pipes 18 and 19 are soldered to the tubular fixing pipes 25 and 26. In this case, the sealed case 2 is thermally damaged if the sealed case 2 is heated for soldering the sealed case 2, after containing the compressor mechanism 4 into the sealed case 2.

Figure 2:
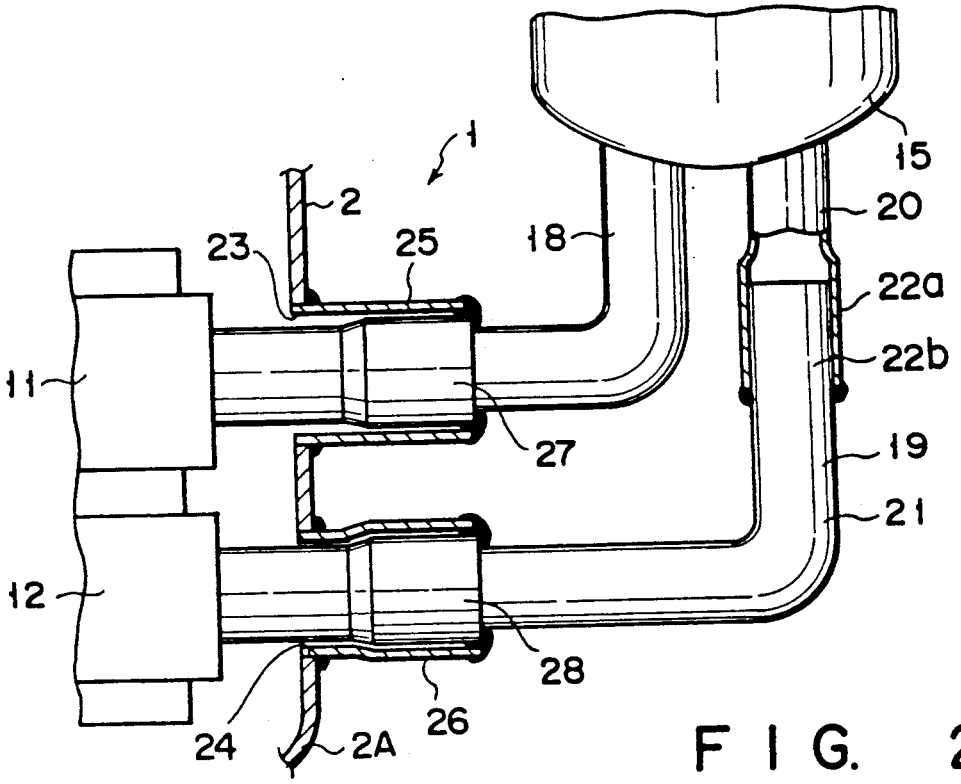

Cylinders 11 and 12 shown in FIG. 2 are housed in a sealed case 2. Through-holes 23 and 24 are formed in the side wall of the sealed case 2 at positions corresponding to the suction portions of the two cylinders 11 and 12. Of the two through holes 23 and 24, the through-hole 24 located on the lower side has a smaller diameter than the through-hole 23 located on the upper side. One end of a tubular fixing pipe 25 is fitted in the upper through hole 23 and welded from the outside.

A tubular fixing pipe 26 has a tapered portion at its intermediate portion, and the diameter of one end portion is decreased. The small-diameter side of the pipe 26 is fitted in the lower through-hole 24 and is welded from the outside.

Auxiliary pipes 27 and 28 whose proximal end portions respectively have outer diameters coinciding with the inner diameters of the openings of the fixing pipes 25 and 26 are inserted in the fixing pipes 25 and 26, respectively. These pipes 27 and 28 are formed into the same shape and have tapered portions at their intermediate portions, respectively. Hence, the diameters of the distal end portions of the pipes 27 and 28 are decreased. These distal end portions are forcibly fitted in the cylinders 11 and 12, respectively. In this case the inner diameter of the lower fixing pipe 26 is set to be close to the outer diameter of the distal end portion of the auxiliary pipe 28.

Since the diameter of the through-hole 24, which is formed near a drawn bottom portion 2A of the sealed case 2, is decreased, strength against deformation, cracks, and the like due to permanent set upon welding can be increased, thus preventing occurrence of these defects.

One end of each of a first suction pipe 18 connected to an accumulator 15 and a second suction pipe 19 constituted by two coupling pipes 20 and 21 is inserted in a corresponding one of the auxiliary pipes 27 and 28 fixed in the above-described manner. Thereafter, the suction pipes 18 and 19, the auxiliary pipes 27 and 28, and the fixing pipes 25 and 26 are coupled in a single welding process. At the same time, in this welding process, coupling portions 22a and 22b of the second suction pipe 19 are welded, thus completing assembly.

With this arrangement, deformation, cracks, and the like due to permanent set upon drawing of the sealed case 2 can be prevented, and stable quality can be ensured.

Figure 3:
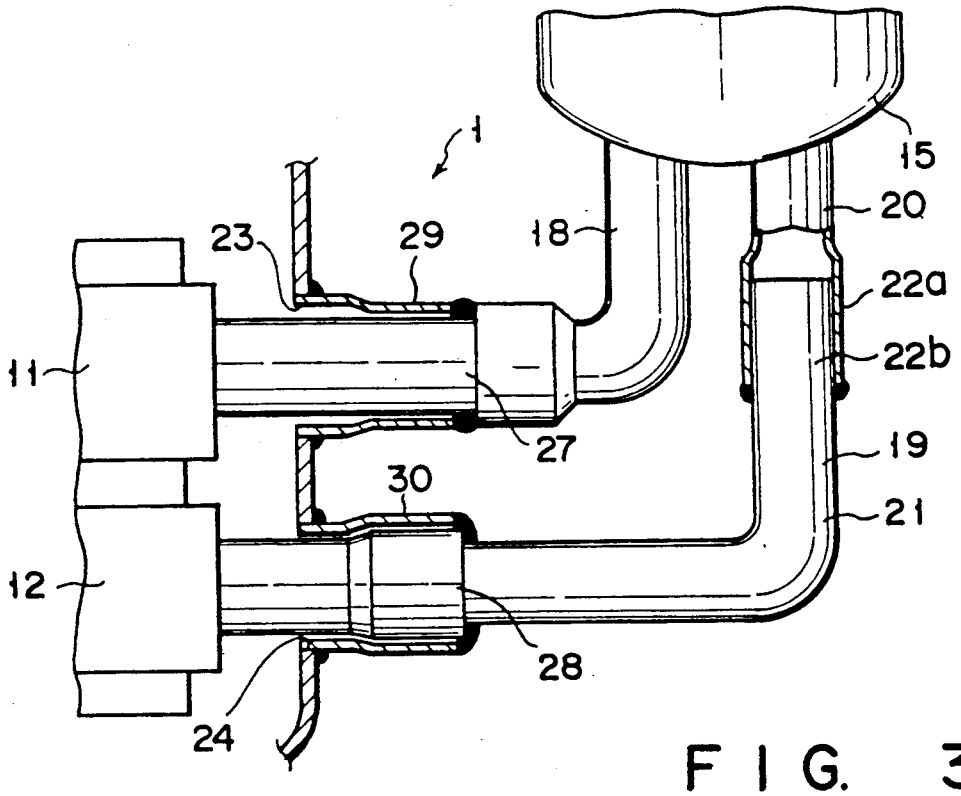
Figure 4:
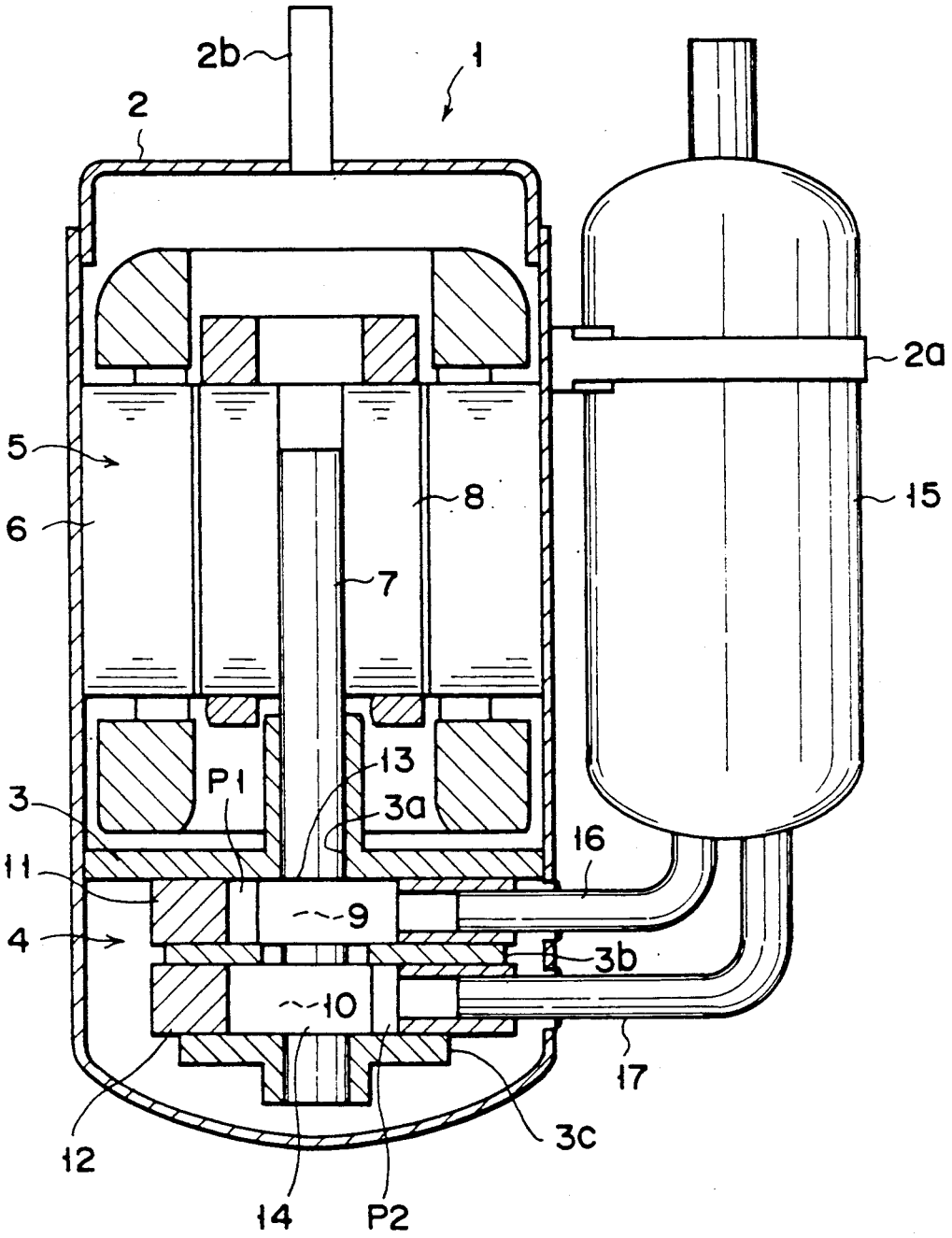
F I G. 4 (PRIOR ART)
FIG. 4 (prior art) is a sectional front view showing a conventional rotary compressor.

In addition, even if the fixing pipes 25 and 26 have shapes shown in FIG. 3, similar effects can be obtained. A through-hole 23 having a large diameter is formed in the upper portion of the sealed case 2 shown in FIG. 3. A through-hole 24 having a smaller diameter than the through-hole 23 is formed below the through hole 23. A tubular fixing pipe 29 has a tapered portion at its intermediate portion, and hence the diameter of the proximal end is larger than that of the remaining portion. The proximal end of the pipe 29 is fitted in the large-diameter through-hole 23 and is welded from the outside. A tubular fixing pipe 30 has a tapered portion at its intermediate portion, and hence the diameter of the proximal end is smaller than that of the remaining portion. The proximal end of the pipe 30 is fitted in the lower through-hole 24 and is welded from the outside.

With this arrangement, the diameter of the through-hole 24 located near the drawn lower portion of the sealed case 2 is decreased, thus preventing deformation, cracks, and the like due to permanent set.

The present invention is not limited to the above-described embodiments. In the second embodiment, the through-hole 24 having a smaller diameter is formed near the drawn portion. However, if welded portions are located near the through-holes 23 and 24, the suction pipes 18 and 19 can be connected without being adversely affected by permanent set upon welding by decreasing the diameters of the through-holes 23 and 24 in the above-described manner.

According to the present invention described above in detail, at the coupling portions of the first and second coupling pipes constituting the second suction pipe, one coupling pipe is inserted in the other coupling pipe to be connected thereto. Therefore, the thickness of the second suction pipe is increased to increase its rigidity, and noise can be reduced. Furthermore, since the coupling portions are formed on the second suction pipe which i arranged outwardly from the first suction pipe, coupling can be facilitated.

In addition, according to the present invention, since the coupling portions having adjustable dimensions are formed on one of the two suction pipes, the distance between the centers of the suction pipes when they are connected to the two cylinders can be easily adjusted. Therefore, even if part precision is low, adjustment can be easily performed, and rejection rate of assembly can be decreased. In addition, assembly efficiency can be increased, and welding of the coupling portions can be increased, and welding of the coupling portions can be facilitated.

What is claimed is:

1. A rotary compressor comprising:

a sealed case having first and second housing portions;

a motor section arranged in the first housing portion of said sealed case and having a rotating shaft extending in the second housing portion;

a compression mechanism section arranged in the second housing portion of said sealed case and having first and second cylinders stacked on each other and first and second crack portions which are formed on said rotating shaft in said first and second cylinders, respectively;

an accumulator arranged outside said sealed case so as to substantially oppose an arrangement position of said motor section;

a first suction pipe for connecting said accumulator to said first cylinder of said compression mechanism section; and a second suction pipe, arranged outwardly from said first suction pipe, for connecting said accumulator to said second cylinder of said compression mechanism section, to said second suction pipe having a first coupling pipe having one end coupled to said second cylinder, a second coupling pipe having one end coupled to said accumulator, and adjustment coupling portions for coupling the other end of each of said first and second coupling pipes so as to freely adjust positions thereof, said adjustment coupling portions including coupling portions allowing one of the other ends of said first and second coupling pipes to be inserted in the other of the other ends and allowing positional adjustment within a predetermined range while allowing a pressure seal to be provided between said first and second coupling pipes at all positions within said predetermined range;

wherein a through-hole formed in said sealed case through which one end of said first coupling pipe to be connected to said second cylinder is inserted in smaller than a through-hole formed in said sealed case through which said first suction pipe is inserted to thereby increase the strength of the sealed case against deformation and cracking due to permanent set upon welding.

2. A compressor according to claim 1, wherein proximal end portions of first and second auxiliary pipes having the same shape and large-diameter portions pipes having the same shape and large-diameter portions at distal end portions thereof are respectively coupled to said first and second cylinders through said through-holes.

3. A compressor according to claim 2, wherein first and second fixing pipes for respectively receiving distal end portions of said first and second auxiliary pipes are fitted in aid through-holes of said sealed case, a proximal end portion of said second fixing pipe having a small-diameter portion corresponding to said through-hole having a small diameter.

4. A compressor according to claim 3, wherein one end of each of said first suction pipe and said first coupling pipe is welded to a corresponding one of distal end portions of said first and second fixing pipes while each one end is inserted in a corresponding one of distal end portions of said first and second auxiliary pipes.

* * * * *